US005699037A

United States Patent [19]

Masuda

[11] Patent Number: 5,699,037

[45] Date of Patent: Dec. 16, 1997

[54] VARIABLE RESISTOR HAVING CLUTCH MECHANISM

[75] Inventor: Fumitoshi Masuda, Sakai-gun, Japan

[73] Assignee: Murata Manufacturing Co., Ltd., Japan

[21] Appl. No.: 531,733

[22] Filed: Sep. 21, 1995

[30] Foreign Application Priority Data

Sep. 28, 1994 [JP] Japan ..... 6-259506

[51] Int. Cl.[6] ..... H01C 10/32

[52] U.S. Cl. ..... 338/162; 338/DIG. 1; 338/167; 338/180; 338/182; 338/190

[58] Field of Search ..... 338/162, 167, 338/174, 180, 182, 192, 193, DIG. 1

[56] References Cited

U.S. PATENT DOCUMENTS

| | | | |
|---|---|---|---|
| 3,124,777 | 3/1964 | Mellor | 338/174 |
| 3,399,367 | 8/1968 | Tumbusch | 338/175 |
| 3,522,573 | 8/1970 | Michik | 338/171 |
| 3,617,977 | 11/1971 | Scheiterbauer et al. | 338/164 |
| 3,683,308 | 8/1972 | Hamill | 338/162 |
| 4,004,264 | 1/1977 | Hogue et al. | 338/174 |
| 4,042,902 | 8/1977 | Meyer et al. | 338/128 |
| 5,047,746 | 9/1991 | Stilwell et al. . | |

FOREIGN PATENT DOCUMENTS

| | | |
|---|---|---|
| 415064 | 7/1963 | Japan . |
| 60-34004 | 2/1985 | Japan . |

*Primary Examiner*—Teresa J. Walberg
*Assistant Examiner*—Karl Easthom
*Attorney, Agent, or Firm*—Ostrolenk, Faber, Gerb & Soffen, LLP

[57] ABSTRACT

A variable resistor comprises a slider body, a contact arm which is provided to project from the slider body, a contact part which is formed by bending the contact arm, an arcuate spring arm having a projection for engaging with an engaging portion of a rotor gear, and a stopper which is formed by bending a stopper member provided to project from the slider body. The arcuate spring arm has an inboard structure connected with the slider body at both ends thereof. The projection engages with the engaging portion of the rotor gear, so that the slider body is rotated following rotation of the rotor gear. When the rotor gear is further rotated in such a state that the stopper comes into contact with a case side stopper which is formed on a case thereby inhibiting the slider body from rotation, the engagement between the engaging portion and the projection is released. Thus, the slider body is prevented from overrotation.

8 Claims, 5 Drawing Sheets

VARIABLE RESISTOR HAVING CLUTCH MECHANISM

BACKGROUND OF THE INVENTION

1. Field of the Invention

The present invention relates to a variable resistor, and more specifically, it relates to a variable resistor having a stopper mechanism for preventing overrotation in adjustment of resistance and comprising a reliable clutch mechanism which can readily adjust the resistance.

2. Description of the Background Art

A variable resistor preferably comprises a stopper mechanism for preventing breakage resulting from overrotation, since the position of a slider (conductive metal plate) cannot be visually confirmed in adjustment of resistance. Further, a multiple rotation adjustment type variable resistor preferably has a clutch mechanism for facilitating adjustment of resistance.

Conventional variable resistors which are related to the inventive variable resistor include a potentiometer disclosed in U.S. Pat. No. 5,047,746 and a variable resistor disclosed in Japanese Patent Laying-Open No. 60-34004 (1985), for example.

The potentiometer which is disclosed in U.S. Pat. No. 5,047,746 comprises a plate (slider) and a rotor for moving the plate. The plate is rotated through rotation of an adjusting shaft for driving the rotor. A contact part (wire finger) is arranged on the plate along a resistance element. Resistance can be adjusted by moving (sliding) the contact part (wire finger). However, this potentiometer has the following problems (1) to (3):

(1) An operation for working the slider is complicated since the slider is formed by mounting a wire on a press-worked spring arm. Further, equipment dedicated to such working is required.

(2) A detent finger (clutch arm) having a free end for engaging with a groove is in such a cantilever structure that only one end thereof is connected with the plate, and hence the effect of the clutch may be varied with the direction of rotation, leading to inferior reliability.

(3) The free end of the detent finger (clutch arm) tends to get entangled with other parts etc. in the assembling steps etc., to remarkably reduce efficiency of the assembling operation.

On the other hand, the variable resistor which is disclosed in Japanese Patent Laying-Open No. 60-34004 has the following problems (1) to (3):

(1) This variable resistor is hard to miniaturize due to the structure of a stopper mechanism since a slit is formed in a rotor by perforation and a finger type elastic member is arranged in the slit, while the parts are hard to work.

(2) When a gear and a worm gear disengage from each other at the termination of rotation, stress which is applied to the finger type elastic member may be so increased that the finger type elastic member is broken, if the gear has a large pitch. Therefore, the degree of freedom in design of the rotational frequency for adjustment is restricted.

(3) When the rotor is made of synthetic resin, the clutch operation is instabilized under a high or low temperature condition. Namely, the condition for using the variable resistor is restricted since spring force of the finger type elastic member tends to reduce under a high temperature, while the finger type elastic member is easy to break under a low temperature.

SUMMARY OF THE INVENTION

The present invention has been proposed in order to solve the aforementioned problems, and an object thereof is to simplify the structure of a slider in a variable resistor comprising a stopper mechanism for preventing breakage resulting from overrotation and a clutch mechanism.

Another object of the present invention is to implement miniaturization of a variable resistor comprising a stopper mechanism and a clutch mechanism.

Still another object of the present invention is to simplify assembling steps for a variable resistor comprising a stopper mechanism and a clutch mechanism.

A further object of the present invention is to improve reliability in operation of a variable resistor comprising a stopper mechanism and a clutch mechanism.

According to the present invention, a variable resistor having a clutch mechanism comprises a rotor which is mounted to be rotatable about an axis, a rotation device for rotating the rotor, a resistance substrate including a resistor film and a collector, a slider which is mounted to be rotatable about the axis, a limiting device for limiting the rotation range of the slider, and a clutch arm having ends which are connected to the slider, while the rotor includes a rotor side engaging portion, the clutch arm includes an engaging portion for engaging with the rotor side engaging portion, and the slider includes a contact part which comes into contact with the resistor film and the collector of the resistance substrate. The rotor is rotated by the rotation device, the slider is rotated following rotation of the rotor in the limited rotation range due to engagement between the engaging portions included in the rotor and the clutch arm respectively, and only the rotor is rotated when the slider is rotated beyond the limited rotation range following said rotation of said rotor, due to cancellation of the engagement between the engaging portions included in the rotor and the clutch arm.

The slider preferably includes a contact arm which is formed by partially bending the slider, and the contact part is preferably formed by bending an end of the contact arm.

Thus, the principal advantage of the present invention resides in that the assembling steps for the variable resistor can be simplified and reliability in operation of the variable resistor can be improved in the variable resistor comprising a stopper mechanism for preventing breakage resulting from overrotation and a clutch mechanism. Since both ends of the clutch arm are connected to the slider, the operation of the clutch is stabilized when the clutch arm is deflected. Thus, the effect of the clutch is stabilized and reliability in operation is improved. Since both ends of the clutch arm are connected to the slider, further, it is possible to prevent reduction of workability caused by entanglement of the clutch arm and other parts in the assembling steps.

The structure of the slider forming the variable resistor can be simplified and the variable resistor can be miniaturized by forming the contact arm and the contact part by partially bending the slider and the contact arm respectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
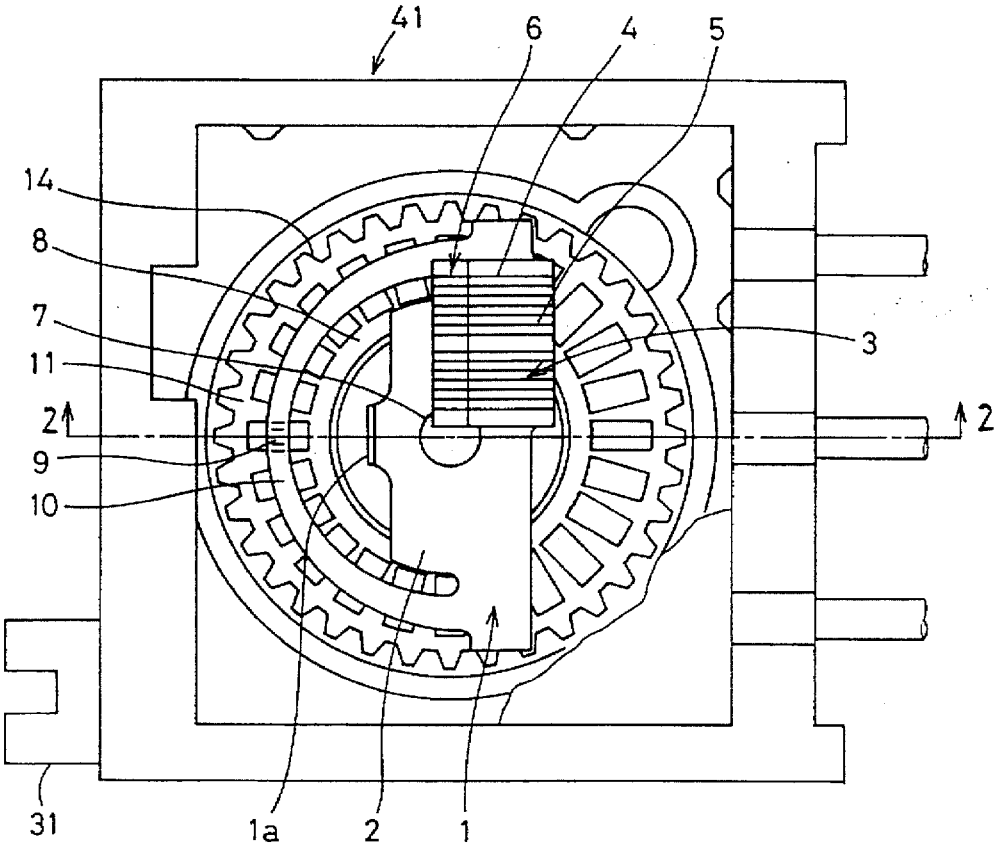
FIG. 1 is a plan view showing a variable resistor according to an embodiment of the present invention, in a state removing a resistance substrate.

An embodiment of the present invention is now described with reference to the drawings.

Referring to the drawings, reference numerals which are identical to each other denote the same or corresponding portions.

As shown in FIGS. 1 to 4, the variable resistor according to this embodiment is formed by storing and arranging a slider 1, a rotor 11, a resistance substrate 21 and a driving part (adjusting screw) 31 for rotating/driving the rotor 11 in a case 41 which consists of an insulator.

Figure 5A:
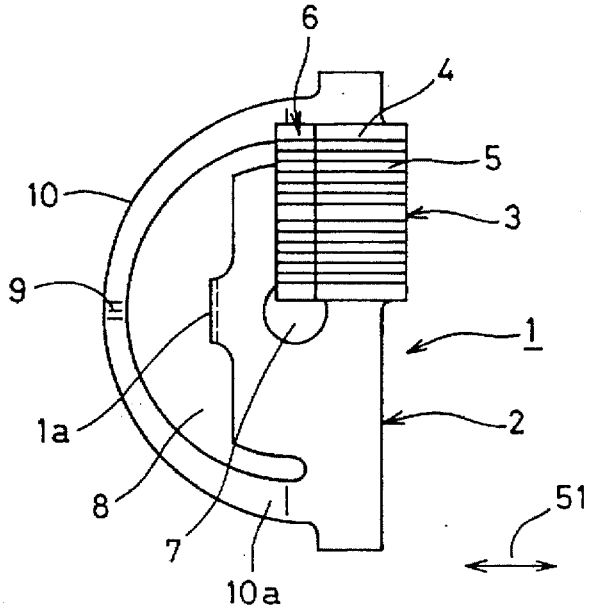
FIGS. 5*a* to 5*c* illustrate a slider 1 of the variable resistor according to the embodiment shown in FIG. 1.
Figure 5B:
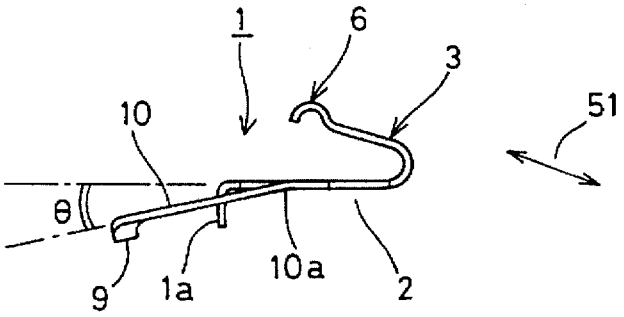
Figure 5C:
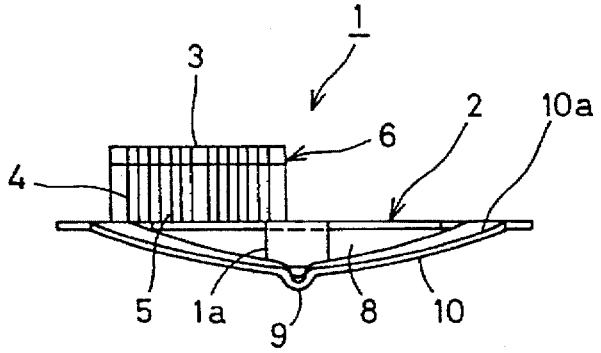

FIGS. 5*a* to 5*c* are a plan view, a front elevational view and a side elevational view illustrating the slider 1 of the variable resistor shown in FIG. 1 respectively.

As shown in FIGS. 5*a* to 5*c*, the slider 1 comprises a slider body 2 consisting of a metal plate having spring quality, a contact arm 3 which is integrally formed with the slider body 2 to project from this slider body 2, a contact part 6 which is formed on an end of the contact arm 3, an arcuate spring arm (clutch arm) 10 having ends which are connected to the slider body 2, and a stopper 1*a* which is integrally formed with the slider body 2 to project from this slider body 2.

The contact part 6 and the contact arm 3 are provided with a plurality of slits 4 substantially in parallel with a direction 51 projecting from the slider body 2. Portions divided by the slits 4 define fingers 5.

In the concrete, the contact part 6 is formed by bending an end of the contact arm 3.

The slider body 2 is provided with a rotary engaging portion (round hole) 7. This rotary engaging portion 7 rotatably engages with a cylindrical projection 43, which is formed on a case 41 as described later.

A slit 8 is defined by parts of the outer peripheries of the slider body 2 and the arcuate spring arm 10.

An engaging portion 9 is provided on a surface of the arcuate spring arm 10 which is directed opposite to that provided with the contact part 6 with respect to the slider body 2. This engaging portion 9 is formed as a concave portion projecting from the surface of the arm 10, in this embodiment.

Figure 6A:
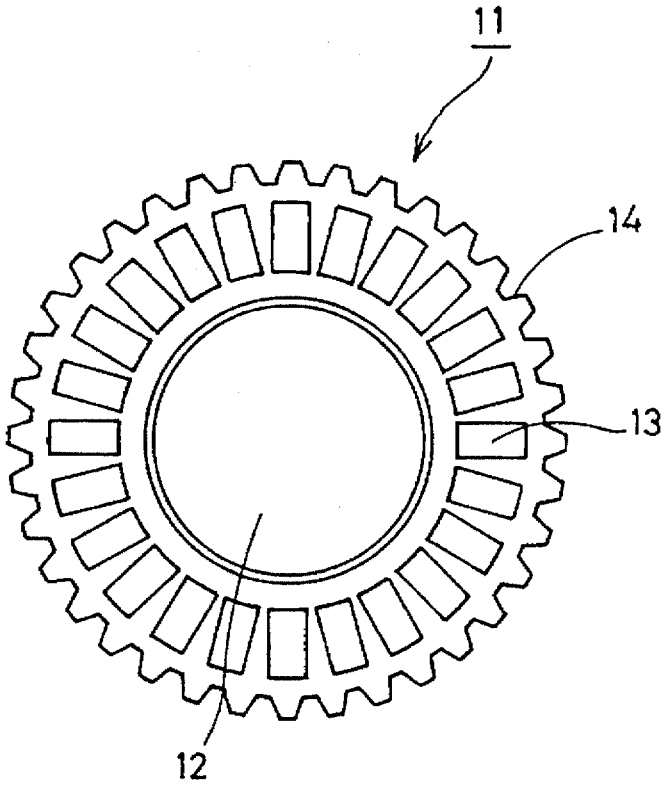
FIGS. 6*a* and 6*b* illustrate a rotor 11 of the variable resistor according to the embodiment shown in FIG. 1.
Figure 6B:
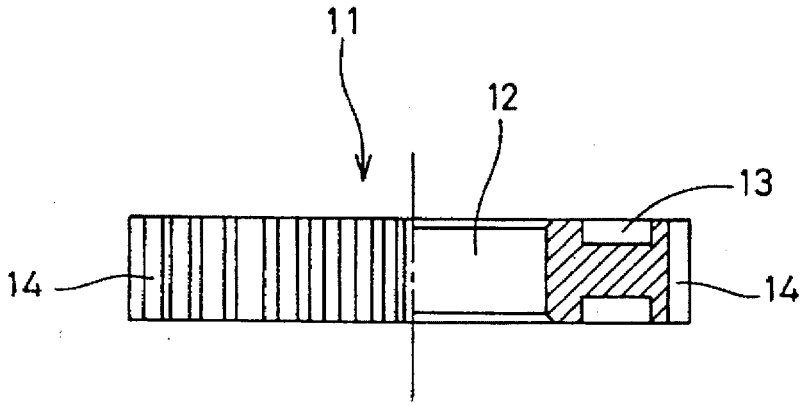

The engaging portion 9 engages with a rotor side engaging portion 13 which is formed in the rotor 11 (FIGS. 6*a* and 6*b*). The stopper 1*a* comes into contact with a case side stopper 41*a* (FIGS. 7*a* and 7*b*) which is formed on the case 41 (FIGS. 7*a* and 7*b*), thereby stopping the rotary motion of the slider 1 about the rotary engaging portion As shown in FIG. 5*b*, the major surfaces of the arcuate spring arm 10 and the slider body 2 are connected with each other at a connecting portion 10*a*, to be at a prescribed angle θ. When the engaging portion 9 engages with the engaging portion 13 which is formed in the rotor 11, the arcuate spring arm 10 supplies the engaging portion 9 with downward urging force with respect to FIG. 5*b*. Thus, the engaging portion 9 is pressed against the engaging portion 13 which is formed in the rotor 11.

Figure 2:
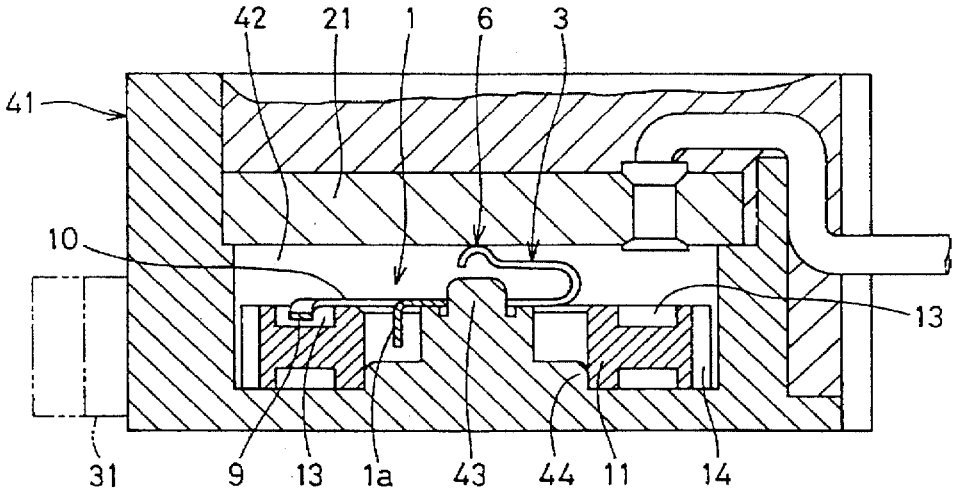
FIG. 2 is a sectional view of the variable resistor according to the embodiment shown in FIG. 1, taken along the line A—A.
Figure 3:
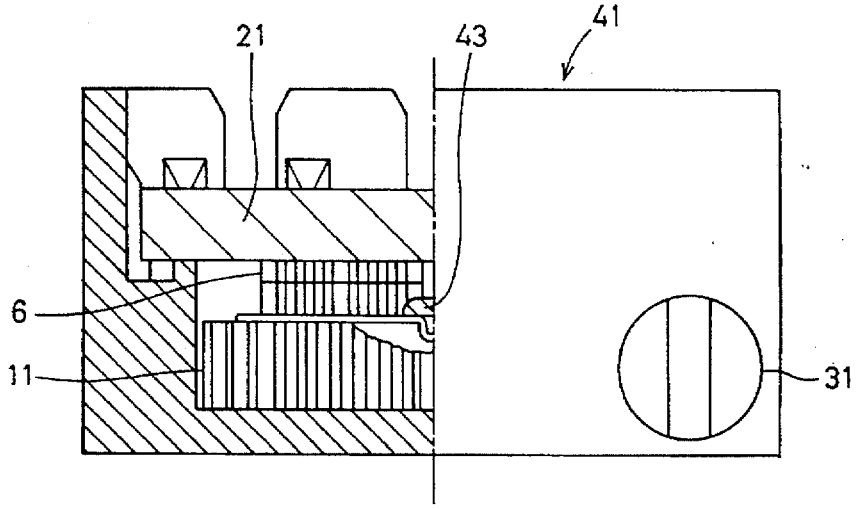
FIG. 3 is a side elevational view of the variable resistor according to the embodiment shown in FIG. 1, sectionally showing a principal part including a case and a substrate.
Figure 4:
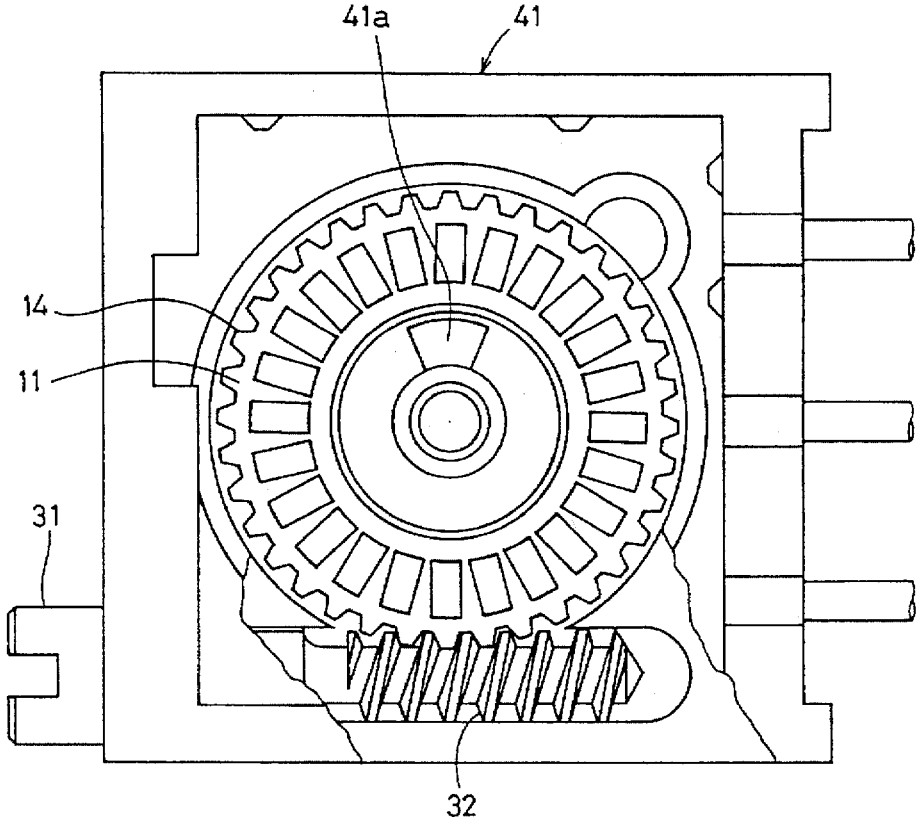
FIG. 4 is a plan view showing the variable resistor according to the embodiment of FIG. 1 in a state removing the resistance substrate and a slider.

The contact arm 3 of the slider 1 is so bent that the contact part 6 is brought into pressure contact with a resistor film and a collector (not shown) which are formed on the resistance substrate 21 (FIGS. 2 and 3). The contact part 6 is formed to have a bent forward end, so that the same reliably comes into contact with the resistor film and the collector (not shown) provided on the resistance substrate 21.

FIGS. 6*a* and 6*b*, illustrating the rotor 11 of the variable resistor shown in FIG. 1, are a plan view and a front sectional view sectionally showing a principal part.

As shown in FIGS. 6*a* and 6*b*, the rotor 11 comprises a through hole 12 for engaging with a cylindrical projection 44 which is arranged in a storage part (storage convex part) 42 of the case 41 (FIGS. 7*a* and 7*b*), the rotor side engaging portion (a plurality of radially formed grooves having U-shaped sections) 13 for engaging with the engaging portion (convex portion) 9 of the arcuate spring arm 10 of the slider 1, and a gear 14 which is formed on the outer peripheral portion of the rotor 11. The gear 14 engages with a screw 32 (FIG. 4) of the driving part (adjusting screw) 31 which is arranged on the case 41.

Figure 7A:
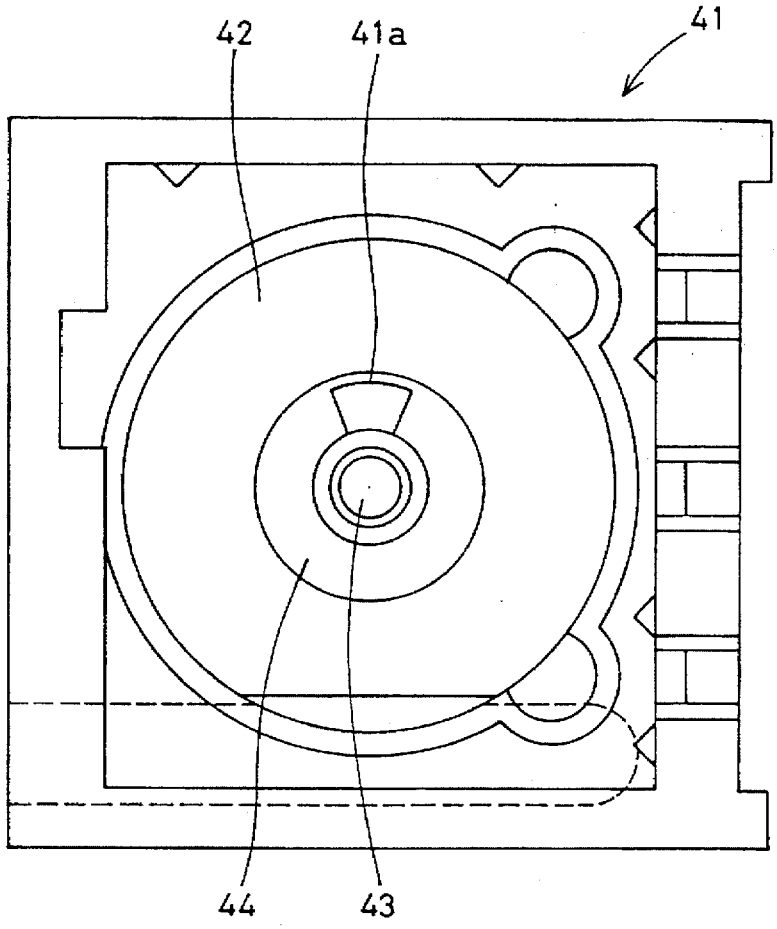
FIGS. 7*a* and 7*b* illustrate a case 41 of the variable resistor according to the embodiment shown in FIG. 1.
Figure 7B:
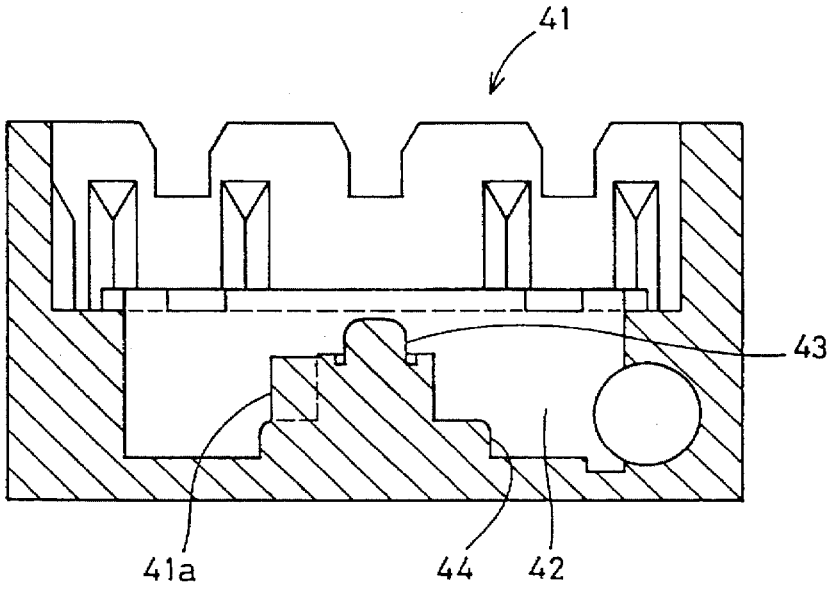

FIGS. 7*a* and 7*b* are a plan view and a side sectional view of the case 41 of the variable resistor shown in FIG. 1.

The case 41 comprises the storage part (storage concave part) 42 storing/holding the rotor 11, cylindrical projections 43 and 44 which are arranged in the storage part 42 for serving as rotary shafts for the slider 1 and the rotor 11 respectively, and the case side stopper 41*a* which engages with the stopper 1*a* of the slider 1 and stops rotation of the slider 1 when the same is rotated to a prescribed position.

When the variable resistor is assembled, the cylindrical projection 44 of the case 41 is made to engage with the through hole 12 of the rotor 11, and thereafter the cylindrical projection 43 of the case 41 is made to engage with the rotary engaging portion (round hole) 7 of the slider 1.

Thus, the rotor 11 and the slider 1 are mounted to be rotatable with respect to the case 41 respectively.

Further, the engaging portion (convex portion) 9 which is formed on the lower surface of the arcuate spring arm 10 engages with the rotor side engaging portion (grooves having U-shaped sections) 13. The slider 1 is rotated with the rotor by an operation of the driving part (adjusting screw) 31.

Further, the resistance substrate 21 comprises two fixed side terminals, variable side terminals (collector terminals), an arcuate resistor film having ends which are connected to the two fixed side terminals, and a collector which is arranged at a substantially central portion of the arcuate resistor film, although these elements are not particularly shown in the figures.

In the variable resistor according to the present invention, the material for forming the slider 1 is preferably prepared from a copper alloy such as nickel silver, phosphor bronze, cupronickel or beryllium bronze, or a noble metal alloy such as an Ag—Pd—Cu alloy, an Au—Pt—Ag—Ni—Zn alloy or an Au—Pt—Ag—Pd—Cu—Zn alloy, while still another material is also employable.

The case 41 and the rotor 11 are preferably prepared from synthetic resin such as PBT (polybutylene terephthalate) resin, PET (polyethylene terephthalate) resin, PA (polyamide) resin (66 nylon, 46 nylon or denatured polyamide 6T), liquid crystal resin or PPS (polyphenylene sulfide) resin. The material for forming the rotor 11 is preferably prepared from polyamide resin having both of toughness and strength in particular, due to repetition of engagement and disengagement with and from the engaging portion 9 of the arcuate spring arm 10. In particular, 46 nylon or denatured polyamide 6T having excellent heat resistance is suitable for guaranteeing a clutch operation over a wide ambient temperature range.

Operations of the respective parts for adjusting resistance in this variable resistor are now described. When the adjusting screw 31 is rotated, the screw 32 of the adjusting screw 31 engages with the gear 14 provided on the outer periphery of the rotor 11, to rotate the rotor 11 in a prescribed direction. At this time, the engaging portion 9 of the arcuate spring arm 10 of the slider 1 which is rotatably held is in engagement with the rotor side engaging portion 13, whereby the slider 1 is rotated (co-rotated) with the rotor 11, so that the contact part 6 of the slider 1 slides on the resistor film and the collector provided on the resistance substrate 21. Thus, the resistance value can be adjusted by rotating the adjusting screw 31 in an arbitrary direction. When the rotor 11 is further rotated and the stopper 1*a* of the slider 1 comes into contact with the case side stopper 41*a*, the arcuate spring arm 10 is deflected to release the engagement between the engaging portion 9 of the arcuate spring arm 10 and the rotor side engaging portion 13, whereby the rotor 11 idles. Consequently, the slider 1 and the like are reliably prevented from breakage resulting from overrotation.

In the aforementioned embodiment, the stopper 1*a* is formed by bending a stopper member which is provided to project from the slider body 2, whereby the same can engage with the case side stopper 41*a* with no requirement for increasing the plane shape of the slider 1. Due to the formation of the stopper 1*a*, therefore, it is possible to effectively prevent the product from dimensional increase. The position of the slider body 2 provided with the stopper member, the shape of the stopper member and the mode of bending the same are not restricted to those in the aforementioned embodiment, but various modifications and applications are employable in the scope of the present invention.

In the variable resistor according to this embodiment, further, the arcuate spring arm 10 of the slider 1 is in an inboard structure with both ends connected with the slider body 2, whereby the clutch effect is stabilized and high reliability is attained in relation to the operation of the slider 1. In addition, the arcuate spring 10 having the inboard structure is not entangled with other parts in the assembling steps to reduce workability.

The contact part 6 is simply formed by bending the contact arm 3 which extends from the slider body 2 and is provided with a plurality of fingers 5, whereby the slider 1 can be formed from a single metal plate. Thus, the slider 1 can be readily worked by a method such as press working, with no requirement for complicated manufacturing steps in particular. Further, the contact part 6 is formed by the plurality of fingers 5, whereby the fingers 5 reliably come into contact with the resistor film and the collector provided on the resistance substrate 21 and the contact resistance thereof can be reduced. Thus, characteristics related to the contact are improved. While the plurality of slits 4 are formed substantially in parallel with the longitudinal direction 51 of the contact arm 3 thereby defining the plurality of fingers 5 on the contact arm 3 in the aforementioned embodiment, the method of forming fingers is not restricted to this but the contact arm 3 may alternatively be cut into a plurality of parts substantially in parallel with the longitudinal direction 51 thereby defining the fingers 5, for example.

Depending on the structures and shapes of the resistor film and the like, the contact part 3 may not consist of a plurality of fingers dissimilarly to the aforementioned embodiment, but may be formed by bending a flat plate type contact arm.

While the arcuate spring arm 10 is inclined toward the rotor side engaging portion 13 by the prescribed angle θ in the connecting portion between the same and the slider body 2 for strongly urging the engaging portion 9 for engaging with the rotor side engaging portion 13 so that the engaging portions 9 and 13 reliably engage with each other in the variable resistor according to the aforementioned embodiment, the basis effect of the present invention can be attained also when the arcuate spring arm 10 is not inclined.

While the rotor side engaging portion 13 for engaging with the engaging portion 9 of the arcuate spring arm 10 is formed by the grooves having U-shaped sections in the aforementioned embodiment, the shape of the rotor side engaging portion 13 is not particularly restricted but any shape is employable so far as the engaging portion 13 reliably engages with the engaging portion 9.

Further, the engaging portion 9 of the arcuate spring arm 10 may not necessarily have a convex shape, but may have any other shape such as a concave shape or an irregular shape such as that of a part of a gear, while the rotor side engaging portion 13 may have a shape such as a convex shape or an irregular shape such as that of a part of a gear reliably engaging with the same.

It is possible to maximize the outer diameter of the resistor film by bending the contact arm 3 while inclining the same outwardly from the slider body 2 as viewed from a plane direction at an arbitrary angle thereby providing allowance for performance such as rated power and characteristics while miniaturizing the overall variable resistor.

While the driving part 31 is formed by an adjusting screw in the aforementioned embodiment, the same may alternatively be formed by a gear or the like.

In the embodiment of the present invention, various applications and modifications are employable in relation to the structure of the resistance substrate, such as the patterns and structures of the resistor film formed on the substrate and the fixed and variable side terminals conducting with the resistor film, and the position of the collector, within the scope of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A variable resistor having a clutch mechanism, comprising:

a rotor mounted to be rotatable about an axis;

a driver for rotating said rotor;

a resistance substrate including a resistor film and a collector;

a slider body mounted to be rotatable through a rotation range about said axis;

limiting means for limiting the rotation range of said slider body; and a clutch arm having ends connected to said slider, said clutch arm extending from said slider body in a first direction substantially parallel to said resistance substrate and defining an internal space between said clutch arm and said slider body; wherein said rotor includes a rotor side engaging portion, said clutch arm includes an engaging portion for engaging with said rotor side engaging portion, contact arm coming into contact with said resistor film and said collector of said resistance substrate, said contact arm having a first part extending from said slider body in a second direction opposite to said first direction and having a second part folded back over the first part to extend in said first direction, said second part including a plurality of individually deflectable contact fingers defined by a plurality of parallel slits in said second part, said rotor is rotated by said rotation means, said limiting means includes first and second stoppers, said first stopper being disposed within said internal space and extending from said slider body in a direction transverse to said first direction such as to engage said second stopper when said slide exceeds said limited rotation range, said slider body is rotated following rotation of said rotor in said limited rotation range due to engagement between said engaging portion included in said rotor and said engaging portion included in said clutch arm, and only said rotor is rotated when said slider body is rotated beyond said limited rotation range following said rotation of said rotor, due to cancellation of said engagement between said engaging portion included in said rotor and said engaging portion included in said clutch arm.

2. The variable resistor having a clutch mechanism in accordance with claim 1, wherein said slider body and said clutch arm are integrally formed with each other.

3. The variable resistor having a clutch mechanism in accordance with claim 1, further comprising a case, said second stopper being formed by a projection disposed on said case.

4. The variable resistor having a clutch mechanism in accordance with claim 1, wherein one of said engaging portions included in said rotor and said clutch arm is a convex portion, and the other said engaging portion is a concave portion.

5. The variable resistor having a clutch mechanism in accordance with claim 1, wherein said clutch arm is formed by an elastic body, said clutch arm supplies said engaging portion of said clutch arm with an urging force toward said engaging portion of said rotor.

6. The variable resistor having a clutch mechanism in accordance with claim 1, wherein said rotor is made of polyamide resin.

7. The variable resistor having a clutch mechanism in accordance with claim 1, wherein gear teeth are provided on the outer periphery of said rotor, said driver including a screw for engaging with said gear teeth.

8. The variable resistor having a clutch mechanism in accordance with claim 1, wherein the clutch arm has an arcuate shape.

* * * * *

UNITED STATES PATENT AND TRADEMARK OFFICE

CERTIFICATE OF CORRECTION

PATENT NO. : 5,699,037

DATED : December 16, 1997

INVENTOR(S) : FUMITOSHI, Masuda

It is certified that error appears in the above-indentified patent and that said Letters Patent is hereby corrected as shown below:

On the title page, item

[30] Foreign Application Priority Data,
after "Sep. 28, 1994 [JP] Japan ..... 6-259506"
insert --Aug. 28, 1995 [JP] Japan ..... 7-243812--.

Signed and Sealed this

Tenth Day of November 1998

*Attest:*

*Attesting Officer*

BRUCE LEHMAN

*Commissioner of Patents and Trademarks*